US011484994B2

(12) United States Patent
Chen

(10) Patent No.: US 11,484,994 B2
(45) Date of Patent: Nov. 1, 2022

(54) SECURING DEVICE FOR SECURING PRESS UNIT TO DRIVING MEMBER OF RATCHET WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 232 days.

(21) Appl. No.: 16/689,079

(22) Filed: Nov. 20, 2019

(65) Prior Publication Data

US 2021/0146507 A1 May 20, 2021

(51) Int. Cl.
*B25B 13/46* (2006.01)

(52) U.S. Cl.
CPC ..... *B25B 13/465* (2013.01); *B25B 13/468* (2013.01)

(58) Field of Classification Search
CPC ..... B25B 13/46; B25B 13/463; B25B 13/465; B25B 13/468; B25B 13/461; B25B 23/0035; B25B 13/462; B25G 1/063
See application file for complete search history.

(56) References Cited

U.S. PATENT DOCUMENTS 299,969 A * 6/1884 Fahy ..... B60B 3/14 411/533
2,641,052 A * 6/1953 Fennema ..... B25B 13/48 29/213.1
3,289,503 A * 12/1966 Klatt, Jr. ..... B25B 15/008 81/436
4,823,651 A * 4/1989 England ..... B25B 13/48 81/437
6,345,559 B1 * 2/2002 Wang ..... B25B 13/461 81/177.2
6,722,232 B1 * 4/2004 Day ..... B25B 13/467 81/56
2013/0319190 A1 * 12/2013 Nino ..... B25B 23/141 81/475
2016/0059390 A1 * 3/2016 Chen ..... B25B 13/465 81/63.2
2018/0029205 A1 * 2/2018 Livingston ..... B25B 21/02

* cited by examiner

*Primary Examiner* — Robert J Scruggs

(57) ABSTRACT

A wrench includes a driving unit located in the head of the wrench. A rod extends through the driving member and includes a stepped recess so as to control a bead in the radial hole of the driving member to secure a socket connected to the driving member. A rotary member is connected to the head and includes a room. A locking member is located in the room and locked to the driving member. A fixing area is formed between the locking member and the driving member so as to fix the locking member and the driving member together. The fixing area ensures that locking member is not separated from the driving member.

3 Claims, 11 Drawing Sheets

SECURING DEVICE FOR SECURING PRESS UNIT TO DRIVING MEMBER OF RATCHET WRENCH

BACKGROUND OF THE INVENTION

1. Fields of the Invention

The present invention relates to a securing device for securing the press unit to the driving member of a ratchet wrench.

2. Descriptions of Related Art

The conventional ratchet wrench known to applicant includes a driving member rotatably installed in the installation hole of the head of the wrench, and a pawl is removably engaged with the toothed portion defined in the inner periphery of the installation hole of the head. The driving member includes a protrusion and a driving block respectively formed on two opposite ends thereof. A rotary member is connected to one side of the head of the wrench so as to control the movement of the pawl. A press unit for controlling a socket to be mounted to the driving block of the driving member or to be released from the driving block of the driving member. The press unit includes a bolt, a rod and a cover, wherein the rod extends through the driving member and is connected to the bolt. A bead is cooperated with the rod, and the bead is controlled by pushing the press unit to be protruded beyond the driving block to positioning a socket mounted to the driving block, or to be accommodated in the driving block to allow the socket to be released from the driving block. The bolt secures the cover to one end of the rod so that the rod is connected to the head of the wrench. A polygonal nut is located in the rotary member and connected to the driving member to connect the driving member to the rotary member.

However, the polygonal nut will be loosened from the driving member when the driving member of the ratchet wrench is used to drive the socket for a period of time. Once the polygonal nut is loosened, the rotary member cannot be properly connected to the driving member, and the driving member may fail to drive the socket.

The present invention is intended to provide a securing device that ensures the connection between the rotary member and the driving member.

SUMMARY OF THE INVENTION

The present invention relates to a wrench and comprises a head and a handle which extends from the head. A driving unit is partially accommodated in an installation hole defined through the head of the wrench. The driving unit includes a driving member which has a first end thereof protruding beyond the head of the wrench. A passage is defined axially through the driving member. A radial hole is defined in the first end of the driving member and communicates with the passage. A rod extends through the passage of the driving member and includes a stepped recess which is located corresponding to the radial hole. The stepped recess includes a first recess and a second recess wherein the first recess is deeper than the second recess. A bead is located between the stepped recess and the radial hole. The bead protrudes beyond the radial hole when the bead is located corresponding to the second recess. The bead is accommodated in the radial hole and does not protrude beyond the radial hole when the bead is located corresponding to the first recess. A rotary member is connected to the head of the wrench and located corresponding to the second end of the driving member. The rotary member has a room defined therein, and a through hole is defined through an inner bottom of the room. The second end of the driving member extends through the through hole and located within the room. A locking member is located in the room and locked to the driving member. A fixing area is formed between the locking member and the driving member so as to fix the locking member and the driving member together, so that the locking member is not separated from the driving member. A press unit is connected to the rotary member and connected to the rod. The press unit seals the room. The press unit is movable in the room to move the rod within the passage of the driving member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
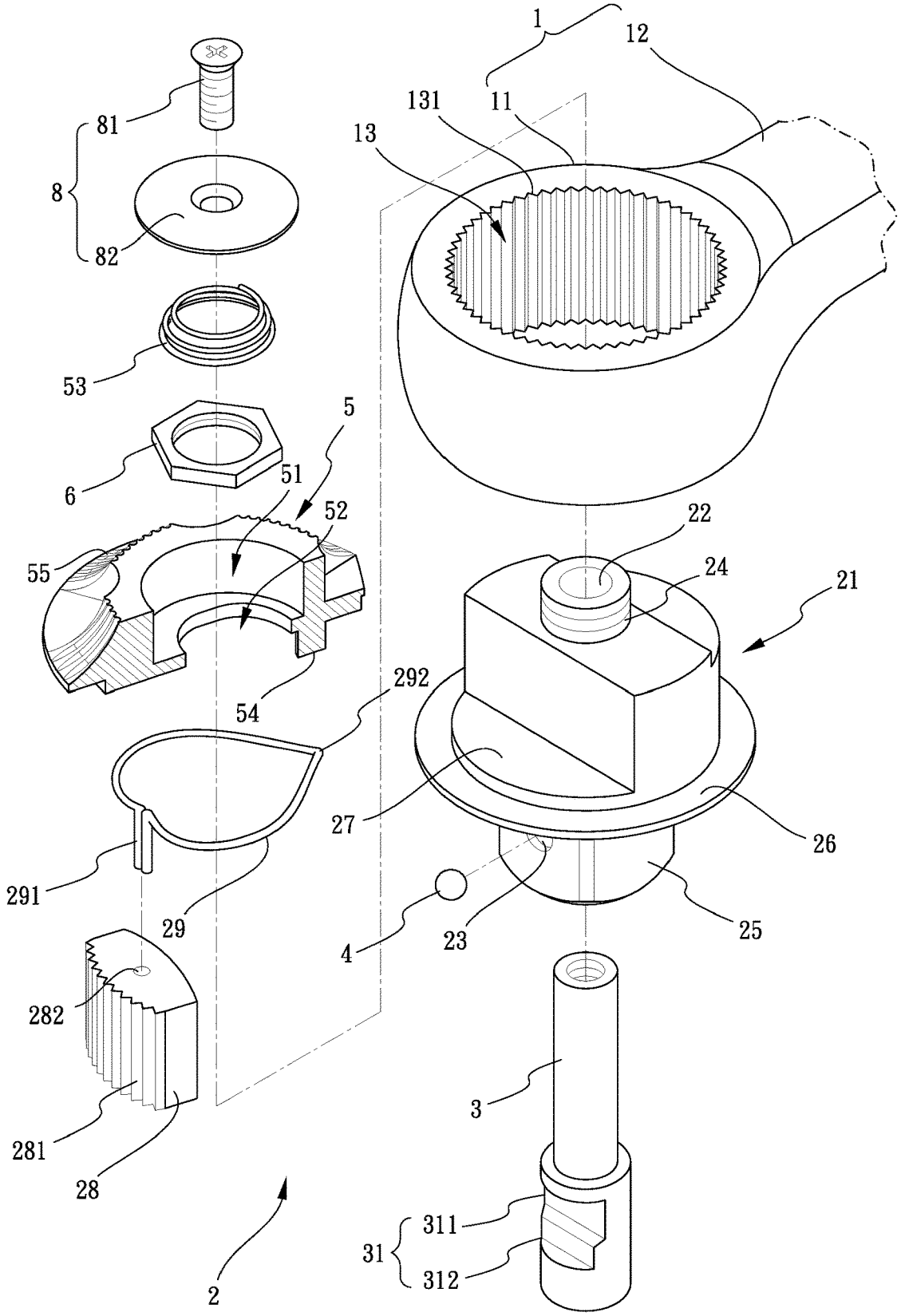
FIG. 1 is an exploded view of the wrench of the present invention.

Referring to FIGS. 1 to 11, the wrench 1 of the present invention comprises a head 11 and a handle 12 which extends from the head 11. An installation hole 13 is defined through the head 11 of the wrench 1. A toothed portion 131 is defined in the inner periphery of the installation hole 13.

Figure 4:
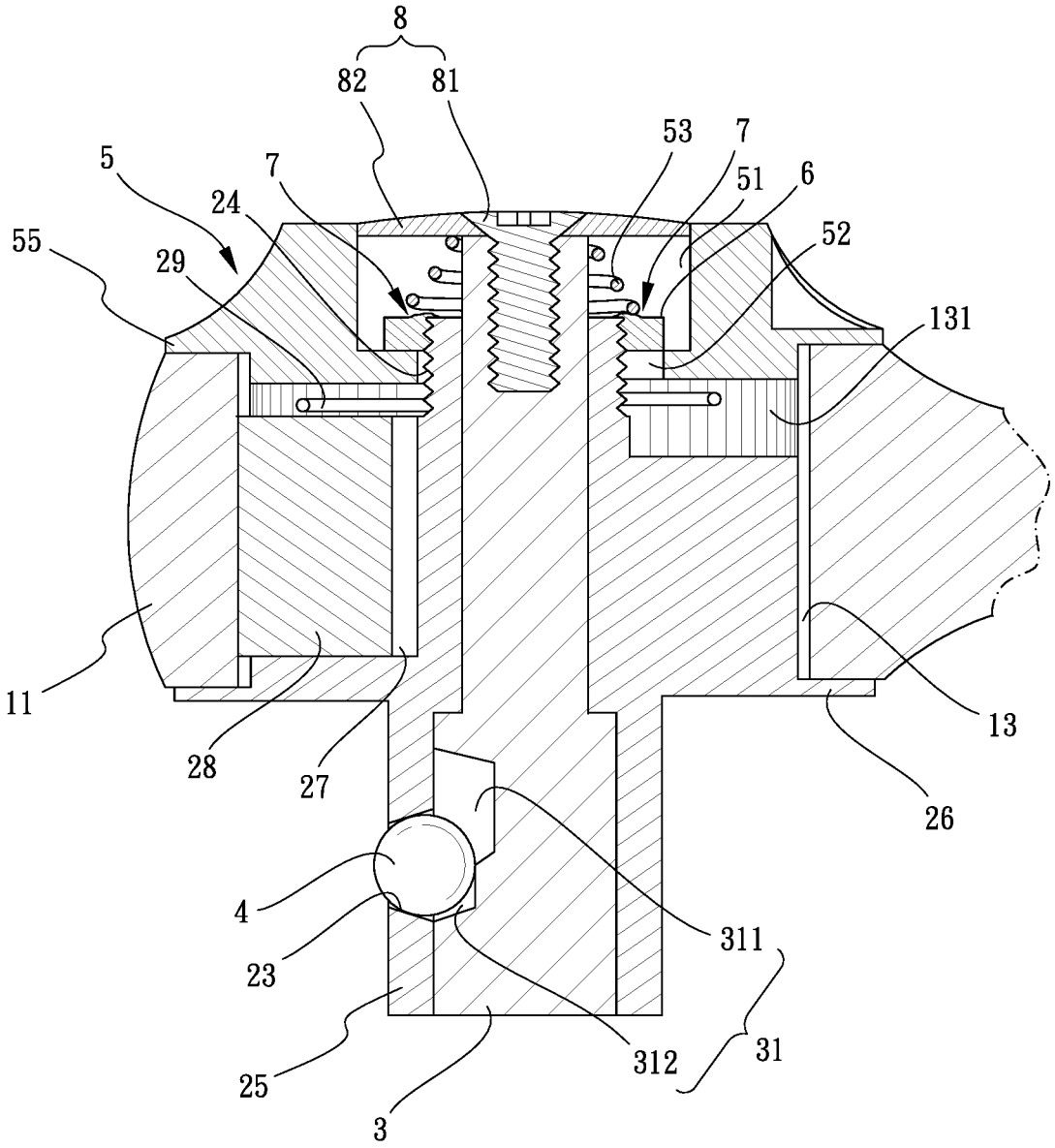
FIG. 4 is an cross sectional view, taken along line IV-IV of FIG. 3.

A driving unit 2 is partially accommodated in the installation hole 13. The driving unit 2 includes a driving member 21, a pawl 28 and a resilient member 29. The driving member 21 has a driving block 25 formed to the first end thereof, and the driving block 25 protrudes beyond the head 11 of the wrench 1. A protrusion is formed to the second end of the driving member 21 and located opposite to the driving block 25. A threaded portion 24 extends from the top of the protrusion on the second end of the driving member 21. A recessed area 27 is defined in the protrusion. A flange 26 extends radially from the driving member 21 and located between the driving block 25 and the protrusion of the driving member 21. The flange 26 contacts the underside of the head 11 of the wrench 1 as shown in FIG. 4. A passage 22 is defined axially through the driving member 21 and the threaded portion 24. A radial hole 23 is defined in the driving block 25 and communicates with the passage 22. The pawl 28 is located in the recessed area 27 and includes engaging teeth 281 which are detachably engaged with the toothed portion 131 of the installation hole 13. The resilient member 29 is a heart-shaped spring and includes a pin 291 extending perpendicularly from one end thereof, and the other end of the resilient member 29 forms a tip end 292. The pin 291 is inserted into a reception hole 282 defined in the top of the pawl 28. The threaded portion 24 is located within the heart-shaped resilient member 29.

A rod 3 extends through the passage 22 of the driving member 21 from the driving block 25 of the first end of the driving member 21, and includes a stepped recess 31 which is located corresponding to the radial hole 23. The stepped recess 31 includes a first recess 311 and a second recess 312, wherein the first recess 311 is radially deeper than the second recess 312. A bead 4 is located between the stepped recess 31 and the radial hole 23. The bead 4 protrudes beyond the radial hole 23 when the bead 4 is located corresponding to the second recess 312. The bead 4 is accommodated in the radial hole 23 and does not protrude beyond the radial hole 23 when the bead 4 is located corresponding to the first recess 311.

A rotary member 5 is connected to the head 11 of the wrench 1 and located corresponding to the protrusion on the second end of the driving member 21. The rotary member 5 has a room 51 defined therein, and a through hole 52 is defined through the inner bottom of the room 51. The protrusion on the second end of the driving member 21 extends through the through hole 52. The threaded portion 24 and the protrusion are located within the room 51. A frictional face 55 is formed on the outer surface of the rotary member 5 such that the user can easily rotate the rotary member 5. An extension 54 extends from the underside of the rotary member 5 and is located within the heart-shaped resilient member 29. The extension 54 is located next to the tip portion 292 of the heart-shaped resilient member 29.

Figure 8:
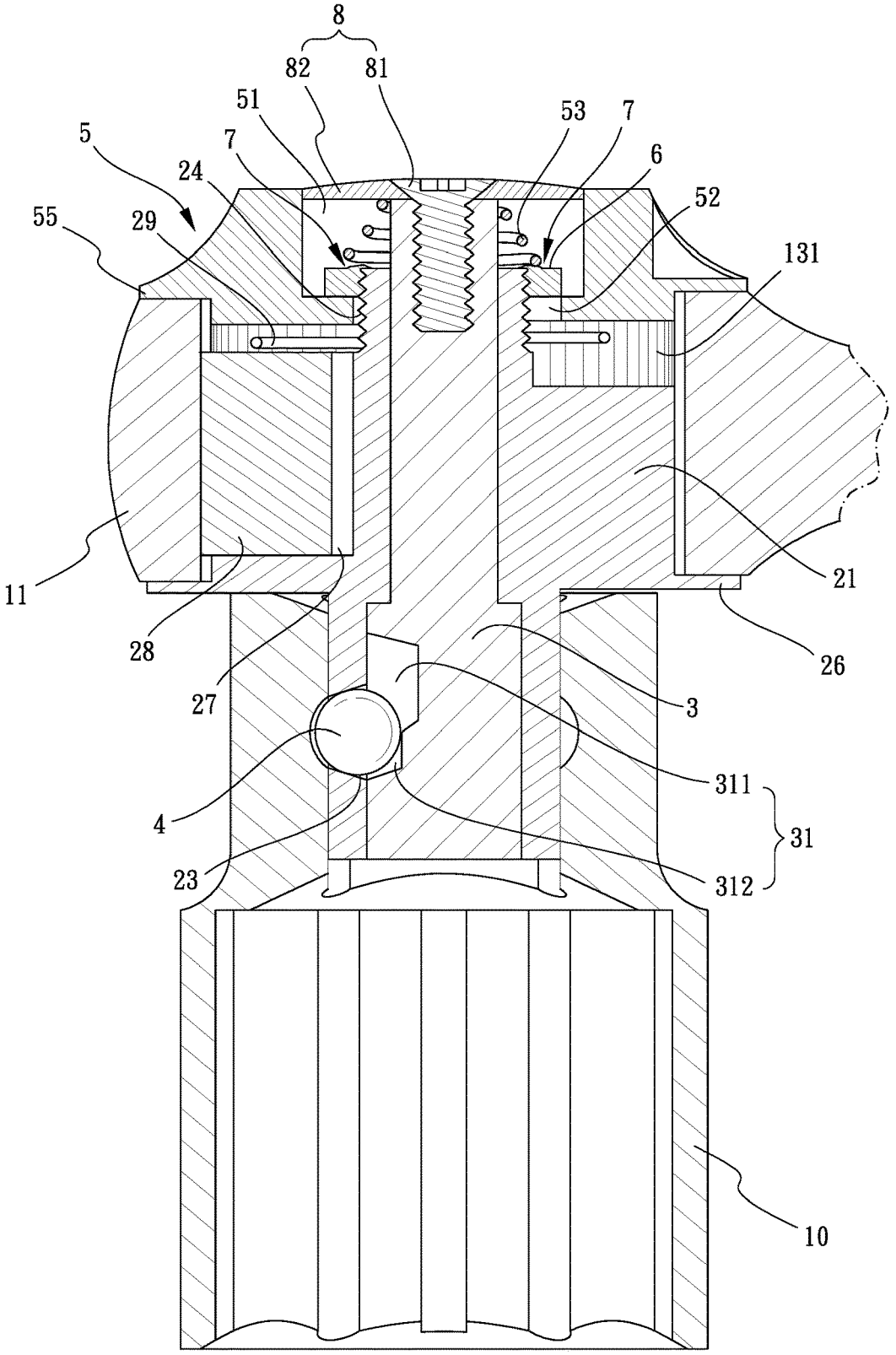
FIG. 8 is an cross sectional view, taken along line VII-VII of FIG. 7.
Figure 9:
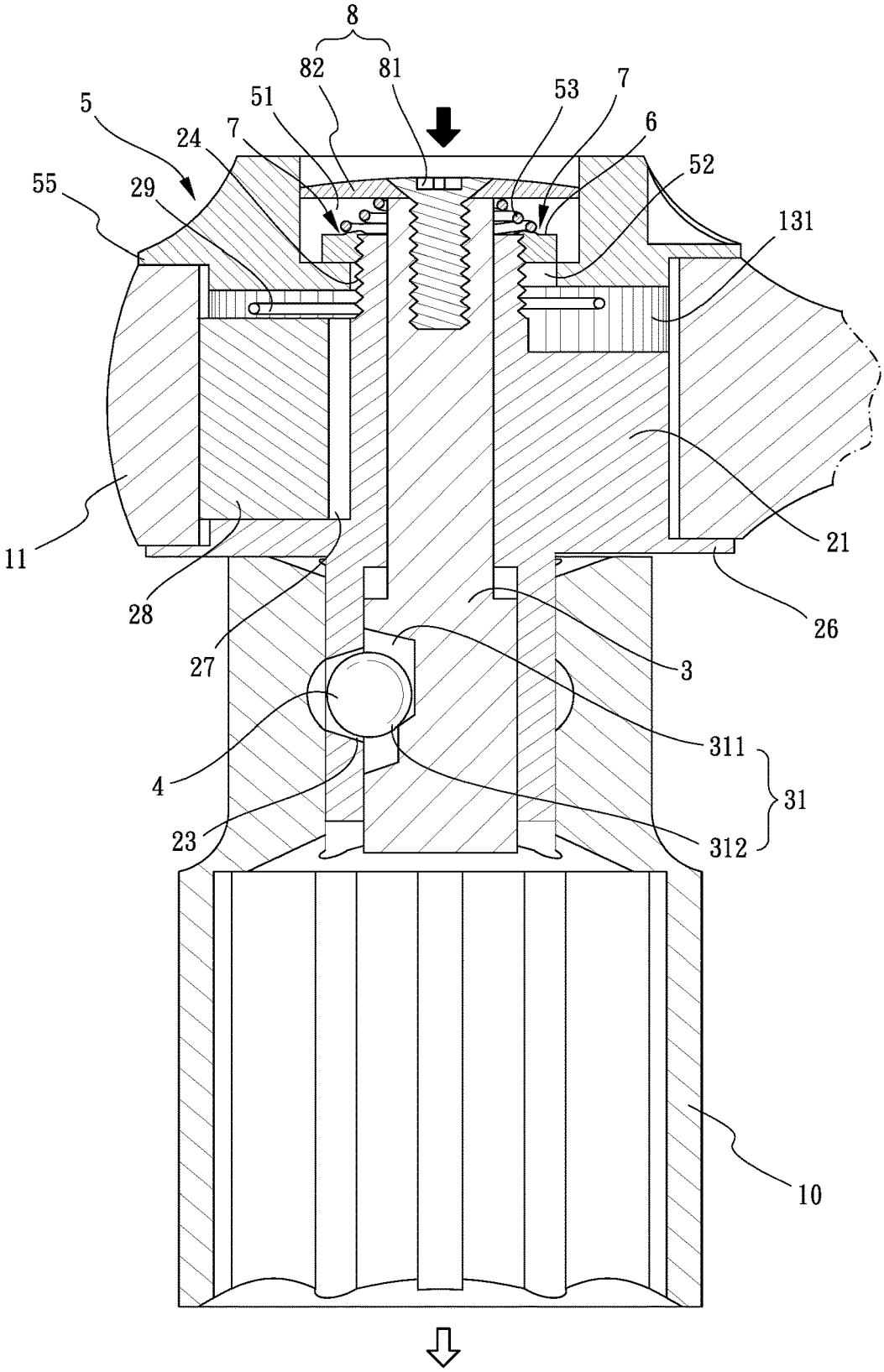
FIG. 9 is a cross sectional view to show that the rod is lowered by pressing the press unit.

A locking member 6 is located in the room 51 and locked to the driving member 21. In this embodiment, the locking member 6 is a polygonal member. A fixing area 7 is formed between the locking member 6 and the driving member 21 so as to fix the locking member 6 and the driving member 21 together. The fixing area 7 ensures that the locking member 6 is not separated from the driving member 21. A press unit 8 is located within the room 51 of the rotary member 5 and connected to the rod 3. The press unit 8 includes a bolt 81 and a cover 82. The cover 82 of the press unit 8 seals the room 51. The bolt 81 extends through a central hole in the cover 82, and a spring 53 is mounted to the bolt 81. The bolt 81 then extends through the locking member 6 and is connected to the rod 3. The locking member 6 is threadedly connected to the threaded portion 24. Therefore, as shown in FIGS. 8 and 9, the press unit 8 is movable in the room 51 by pressing the cover 82 to move the rod 3 within the passage 22 of the driving member 21. As shown in FIG. 8, when the press unit 8 is not pressed, the bead 4 is located corresponding to the second recess 312, and the bead 4 protrudes beyond the radial hole 23 to secure the socket 10 mounted to the driving block 25. When the press unit 8 is pressed as shown in FIG. 9, the bead 4 is located corresponding to the first recess 311, and the bead 4 is accommodated in the radial hole 23 and does not protrude beyond the radial hole 23, so that the socket 10 can be easily removed from the driving block 25.

When changing the ratcheting direction of the wrench 1 while the socket 10 is connected to the driving block 25, the user rotates the rotary member 5 so that the extension 54 drives the tip end 292 of the heart-shaped resilient member 29, and the pin 291 of the heart-shaped resilient member 29 moves the pawl 28 to change the ratcheting direction of the driving member 21 to output a torque via the socket 10.

Figure 2:
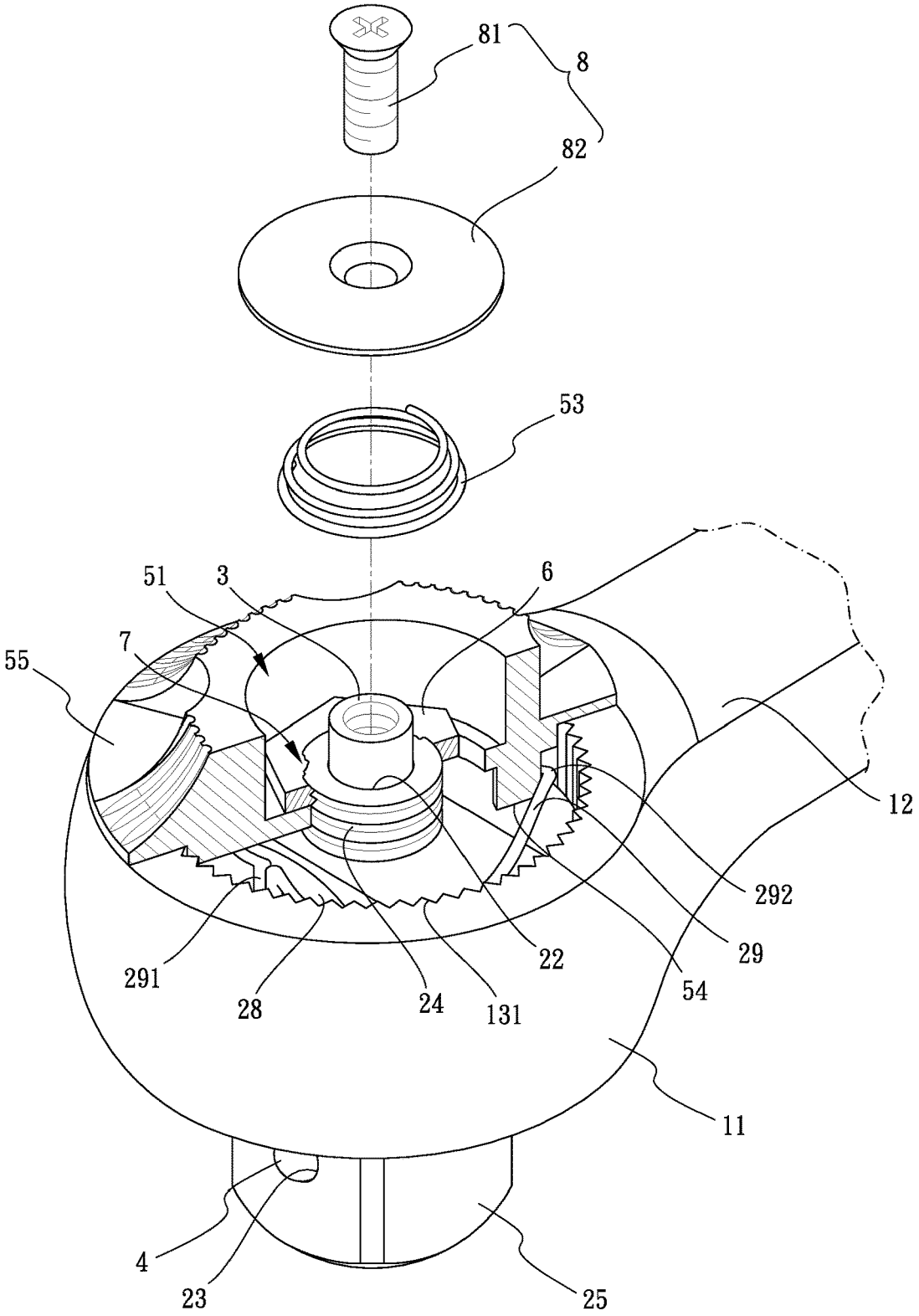
FIG. 2 is a perspective view to show the fixing area formed between the locking member and the driving member, and the press unit is to be installed to the head of wrench the present invention.
Figure 3:
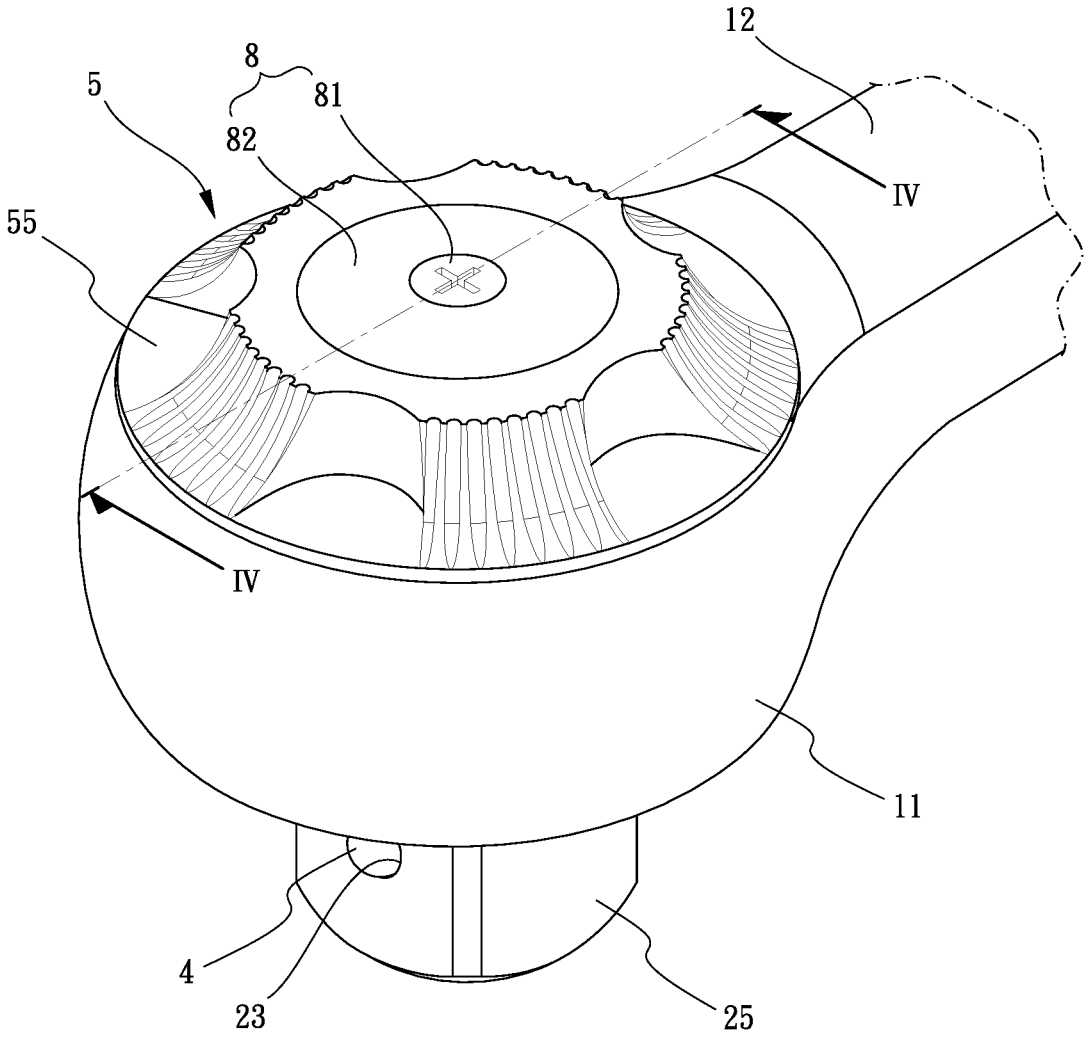
FIG. 3 is a perspective view to show the wrench of the present invention.
Figure 5:
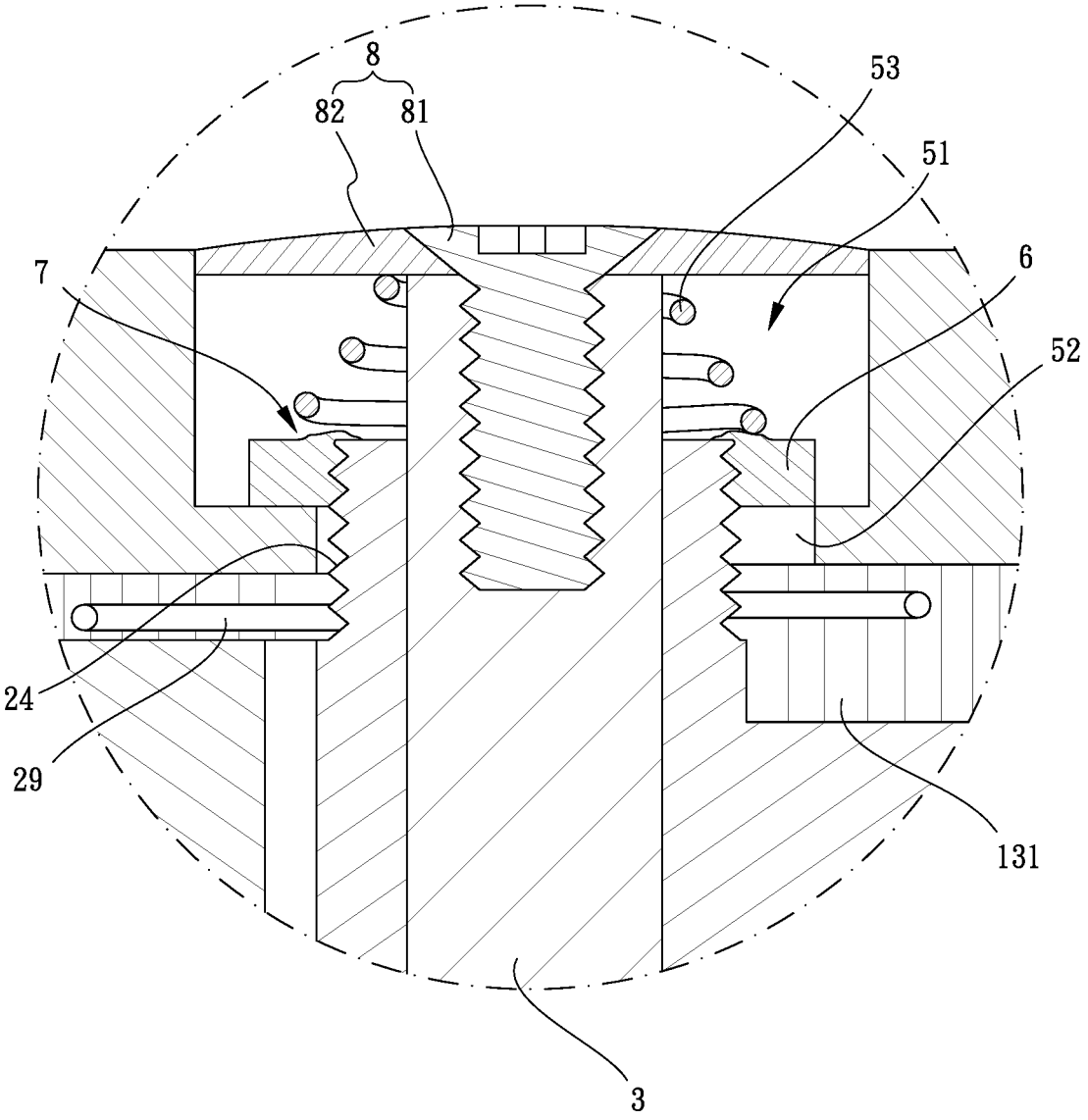
FIG. 5 is an enlarged and cross sectional view to show the connection between the press unit and the rod, and the fixing area formed between the locking member and the driving member.
Figure 6:
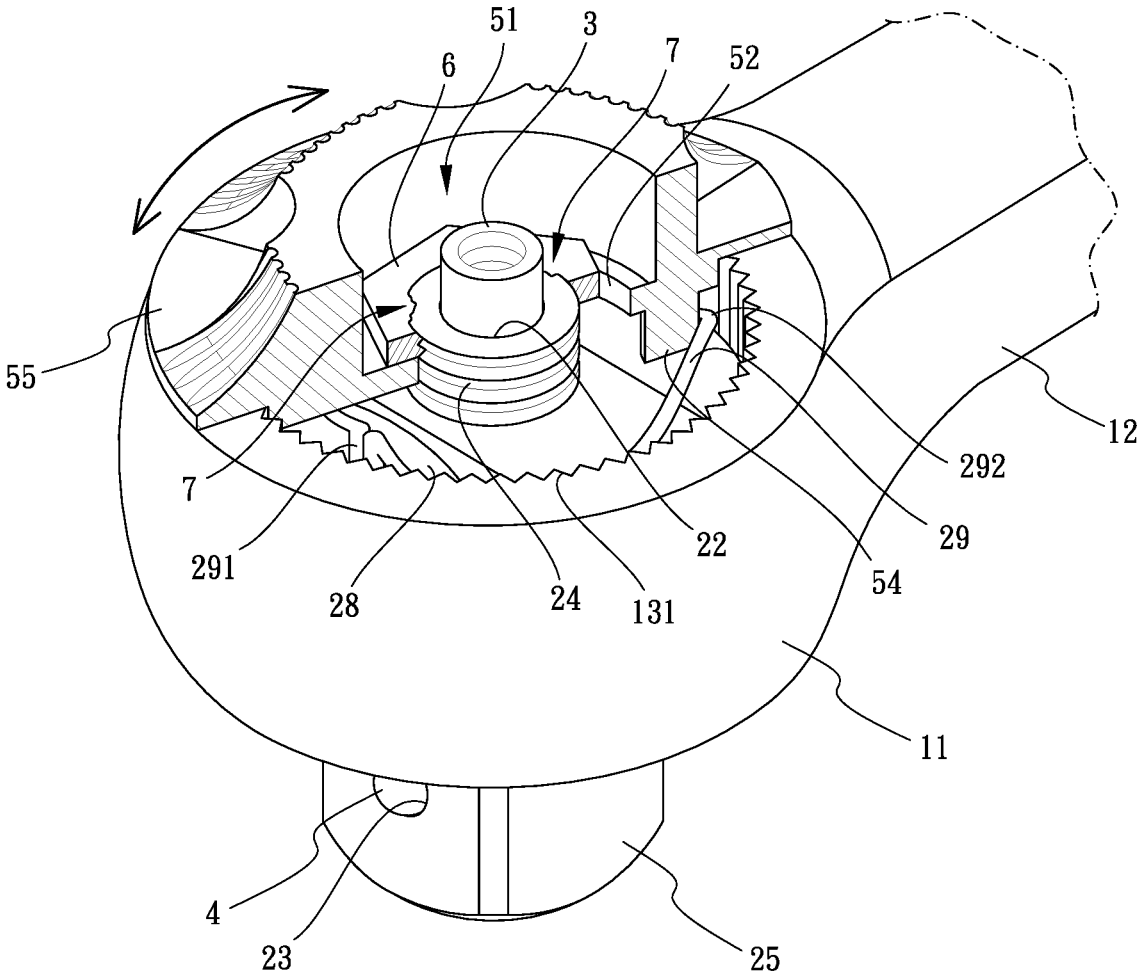
FIG. 6 is a perspective view, partly removed, to show that the rotary member is rotated.
Figure 7:
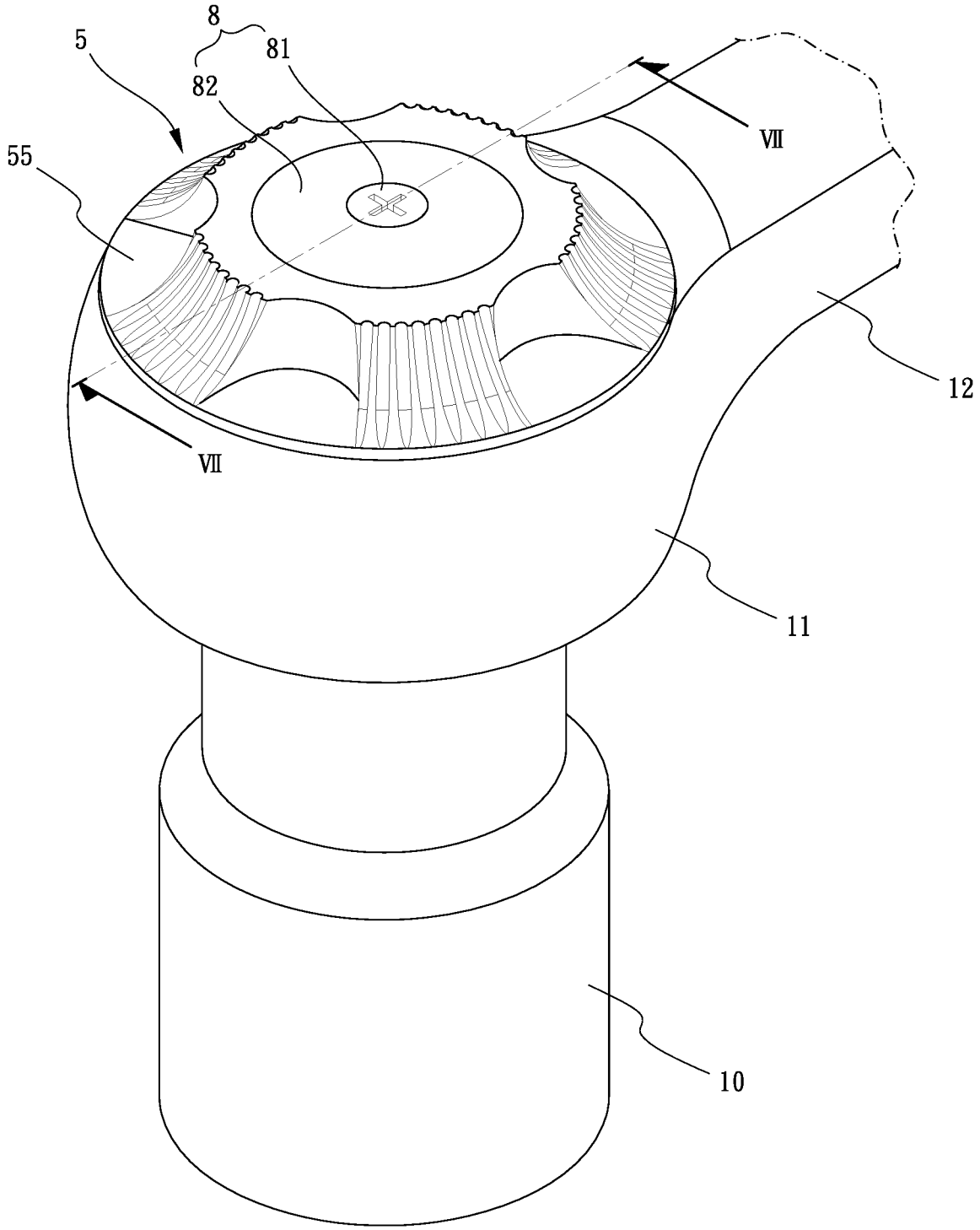
FIG. 7 is a perspective view to show that a socket is connected to the wrench of the present invention.

It is noted that the fixing area 7 is machined as shown in FIGS. 2, 4 and 5, to deform the top of the locking member 6 or to damage the threads of the locking member 6 so that the locking member 6 cannot rotate relative to the threaded portion 24. Therefore, the locking member 6 is securely fixed to the threaded portion 24.

Figure 10:
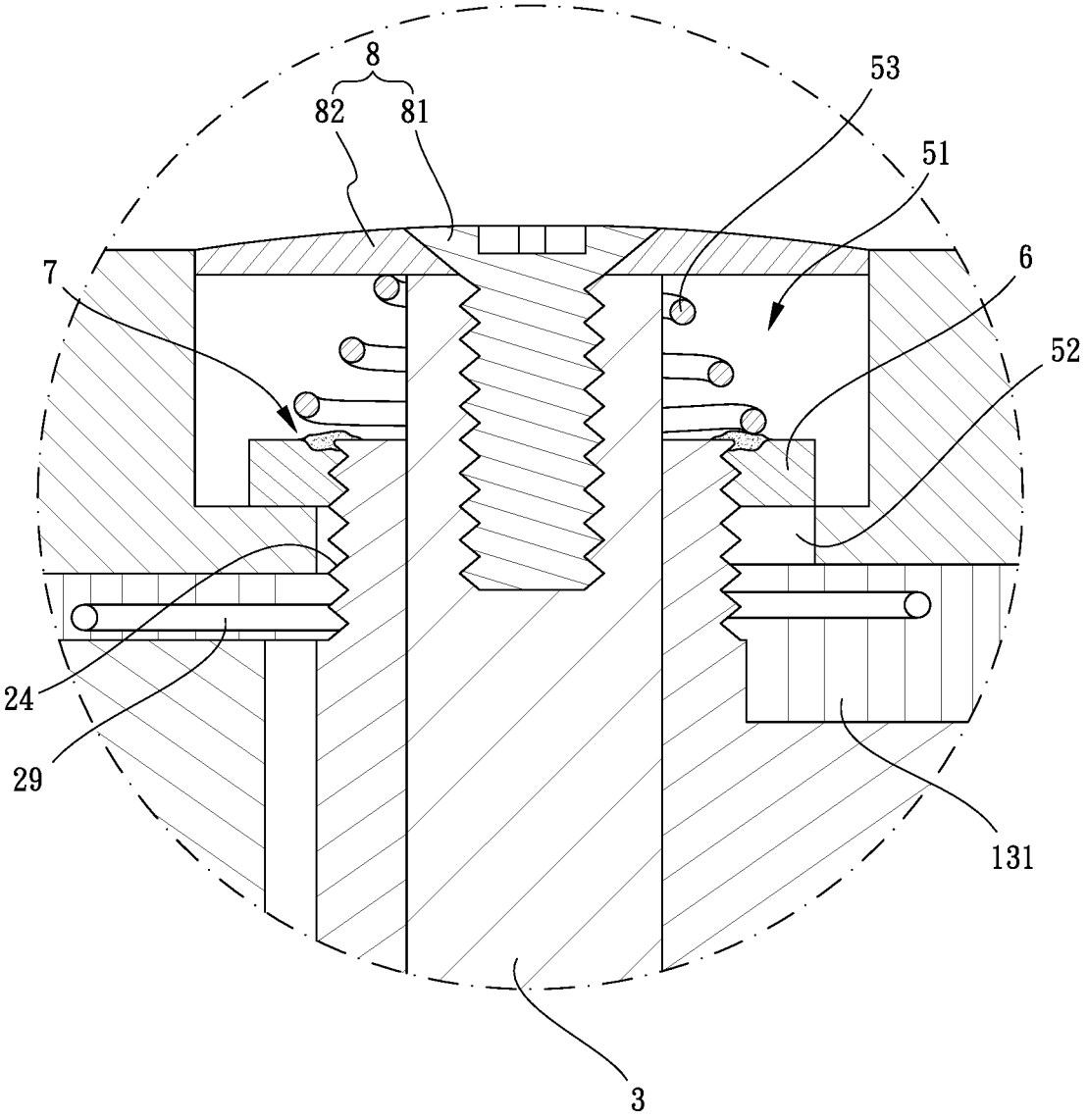
FIG. 10 shows that the fixing area is a welded area between the locking member and the driving member.
Figure 11:
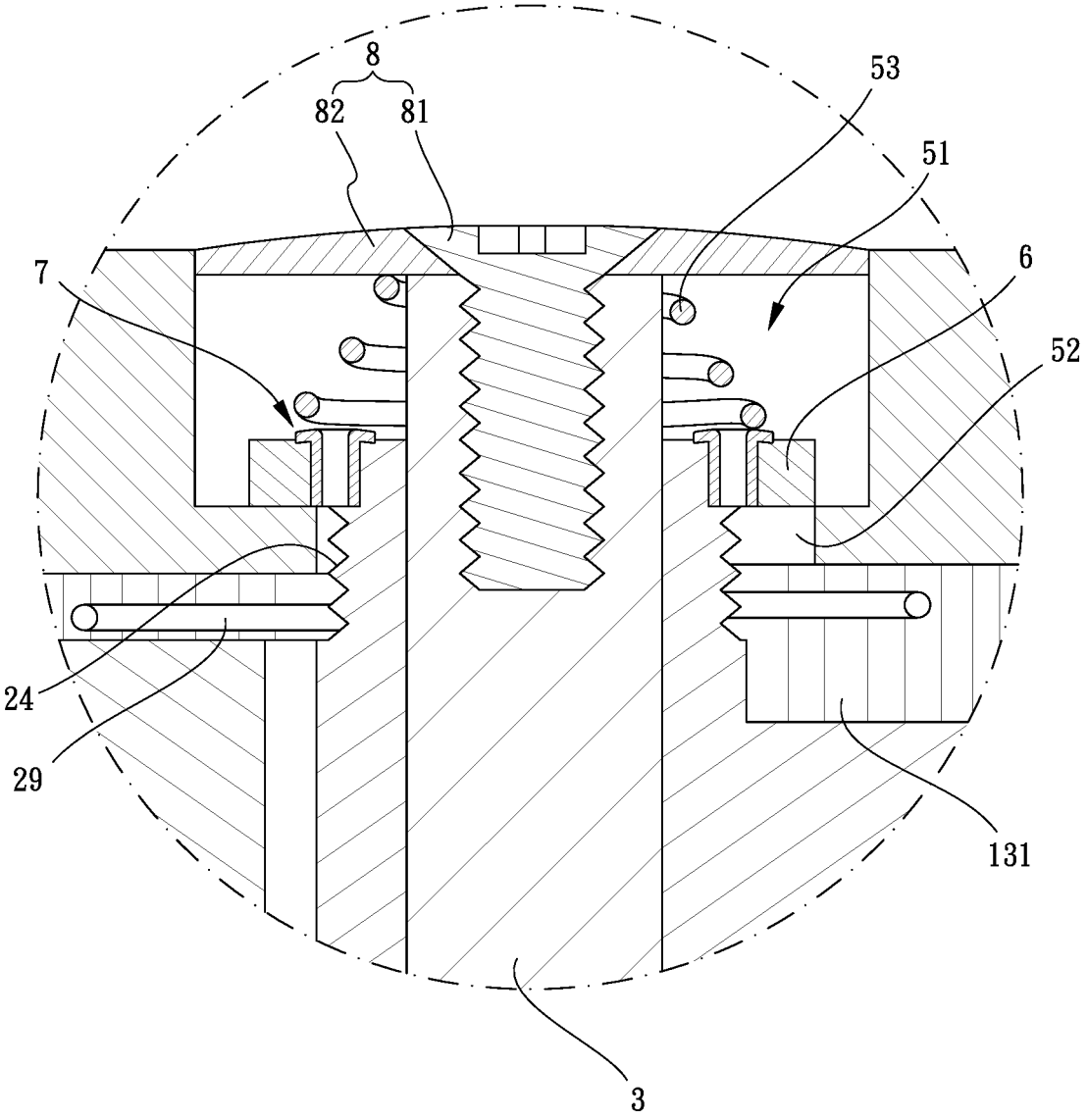
FIG. 11 shows that the fixing area is a riveting area between the locking member and the driving member.

FIG. 10 shows that the fixing area 7 is a welded area to weld the locking member 6 to the threaded portion 24. FIG. 11 shows that the fixing area 7 is a riveting area to securely fix the locking member 6 and the threaded portion 24 together.

While we have shown and described the embodiment in accordance with the present invention, it should be clear to those skilled in the art that further embodiments may be made without departing from the scope of the present invention.

What is claimed is:

1. A wrench comprising:

a head and a handle which extends from the head, an installation hole defined through the head of the wrench;

a driving unit partially accommodated in the installation hole, the driving unit including a driving member which has a first end thereof protruding beyond the head of the wrench, the driving member including a protrusion formed to a second end thereof, a threaded portion extending from a top of the protrusion on the second end of the driving member, a passage defined axially through the driving member and the threaded portion, a radial hole defined in the first end of the driving member and communicating with the passage;

a rod extending through the passage of the driving member and having a stepped recess which is located corresponding to the radial hole, the stepped recess including a first recess and a second recess, the first recess being deeper than the second recess;

a bead located between the stepped recess and the radial hole, the bead protruding beyond the radial hole when the bead is located corresponding to the second recess, the bead being accommodated in the radial hole and not protruding beyond the radial hole when the bead is located corresponding to the first recess;

a rotary member connected to the head of the wrench and located corresponding to the second end of the driving member, the rotary member having a room defined therein, a through hole defined through an inner bottom of the room, the second end of the driving member extending through the through hole and located within the room;

a locking member located in the room and locked to the driving member, a fixing area being formed between the locking member and the driving member so as to fix the locking member and the driving member together, the locking member not being separated from the driving member, the fixing area being a welded area and formed by deforming a top of the locking member and a top of the threaded portion so as to form the locking member to the threaded portion of the second end of the driving member, and a press unit located in room of the rotary member and connected to the rod, the press unit sealing the room, the press unit movable in the room to move the rod within the passage of the driving member.

2. The wrench as claimed in claim 1, wherein a driving block is formed to the first end of the driving member and extends beyond the head of the wrench, a flange extends radially from the driving member and located between the first and second ends of the driving member, the flange contacts the head of the wrench, the threaded portion and the second end of the driving member are located in the head of the wrench.

3. A wrench comprising:

a head and a handle which extends from the head, an installation hole defined through the head of the wrench;

a driving unit partially accommodated in the installation hole, the driving unit including a driving member which has a first end thereof protruding beyond the head of the wrench, the driving member including a protrusion formed to a second end thereof, a threaded portion extending from a top of the protrusion on the second end of the driving member, a passage defined axially through the driving member and the threaded portion, a radial hole defined in the first end of the driving member and communicating with the passage;

a rod extending through the passage of the driving member and having a stepped recess which is located corresponding to the radial hole, the stepped recess including a first recess and a second recess, the first recess being deeper than the second recess;

a bead located between the stepped recess and the radial hole, the bead protruding beyond the radial hole when the bead is located corresponding to the second recess, the bead being accommodated in the radial hole and not protruding beyond the radial hole when the bead is located corresponding to the first recess;

a rotary member connected to the head of the wrench and located corresponding to the second end of the driving member, the rotary member having a room defined therein, a through hole defined through an inner bottom of the room, the threaded portion of the driving member extending through the through hole and located within the room;

a locking member located in the room and locked to the driving member, a fixing area being formed between the locking member and the driving member so as to fix the locking member and the threaded portion of the driving member together, the locking member not being separated from the threaded portion of the driving member, the fixing area being a riveting area and formed by riveting the locking member to a top of the threaded portion on the top of the protrusion on the second end of the driving member, and a press unit located in room of the rotary member and connected to the rod, the press unit seating the room, the press unit movable in the room to move the rod within the passage of the driving member.

* * * * *